US006554154B1

(12) United States Patent
Chauhan et al.

(10) Patent No.: US 6,554,154 B1
(45) Date of Patent: Apr. 29, 2003

(54) THERMOFORMED CONTAINER HAVING IMPROVED STRENGTH TO WEIGHT RATIO IN SIDEWALL

(75) Inventors: Rajendra R. Chauhan, Skokie, IL (US); John S. Gitschlag, Chicago, IL (US)

(73) Assignee: Solo Cup Company, Highland Park, IL (US)

( * ) Notice: Subject to any disclaimer, the term of this patent is extended or adjusted under 35 U.S.C. 154(b) by 0 days.

(21) Appl. No.: 09/503,601

(22) Filed: Feb. 11, 2000

(51) Int. Cl.[7] ..... B65D 1/00
(52) U.S. Cl. ..... 220/671; 220/675; 229/400
(58) Field of Search ..... 220/669, 671, 220/675; 229/400, 403

(56) References Cited

U.S. PATENT DOCUMENTS

| | | | | |
|---|---|---|---|---|
| 2,629,534 A | * | 2/1953 | Reynolds | 200/669 |
| 3,009,603 A | * | 11/1961 | Stockdale | 220/675 X |
| 3,126,139 A | * | 3/1964 | Schechter | 229/403 |
| D198,139 S | * | 5/1964 | Edwards | 220/675 X |
| 3,131,845 A | * | 5/1964 | Sherlock et al. | 229/400 |
| 3,139,213 A | * | 6/1964 | Edwards | 229/400 X |
| 3,951,266 A | | 4/1976 | Brewer | |
| 4,049,187 A | | 9/1977 | Florian | |
| 4,052,037 A | | 10/1977 | Mair et al. | |
| 4,548,348 A | | 10/1985 | Clements | |
| 5,423,160 A | | 6/1995 | Rosén | |

FOREIGN PATENT DOCUMENTS

| | | |
|---|---|---|
| DE | 44 19 161 A1 | 12/1995 |
| DE | 298 02 377 U1 | 6/1998 |
| GB | 395996 | 8/1932 |

* cited by examiner

*Primary Examiner*—Steven Pollard
(74) *Attorney, Agent, or Firm*—Wallenstein & Wagner, Ltd.

(57) ABSTRACT

A container sidewall, such as for a cup or the like, made of a thermoplastic material is disclosed. The container utilizing the present invention is preferably designed having a closed bottom wall at one end, an open top at the opposite end, and the present sidewall extending between the bottom wall and the open top to define a height. The sidewall has a top portion adjacent the open top of the container, a first set of annular ribs disposed adjacent the top portion, a second set of annular ribs, a middle portion disposed between the first set and second set of annular ribs, and a bottom portion disposed adjacent the closed bottom wall of the container. The double band of ribs provide an increase in the strength-to-weight ratio of the container over single band prior art designs.

59 Claims, 6 Drawing Sheets

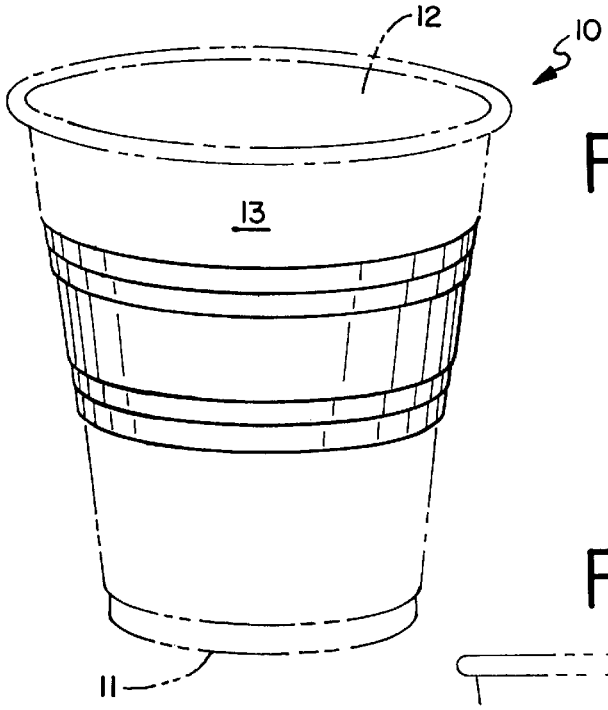
FIG. 1
FIG. 2
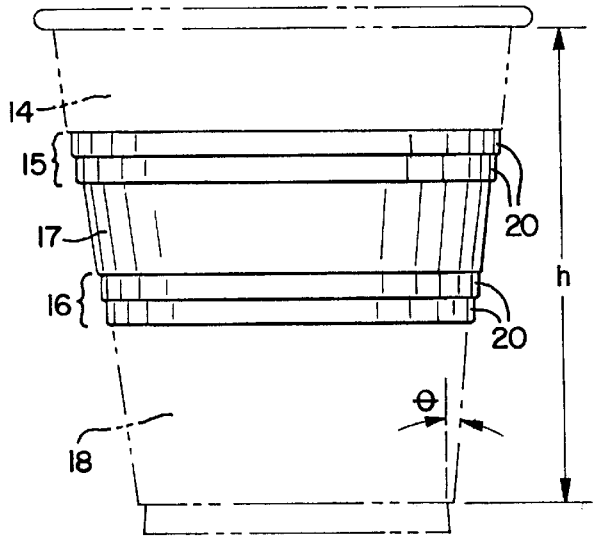
FIG. 3
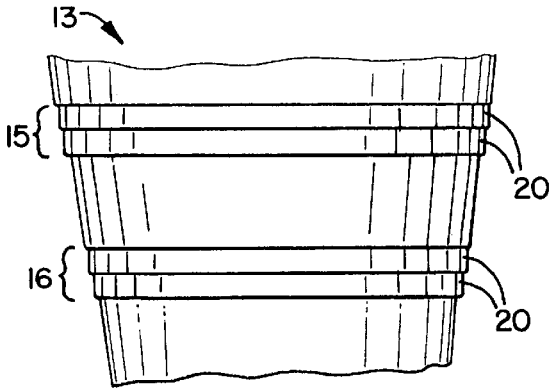

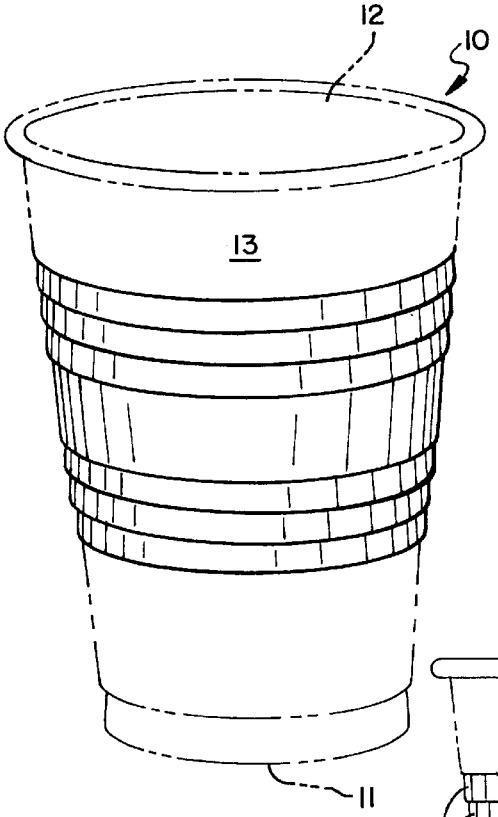
FIG. 4
FIG. 5
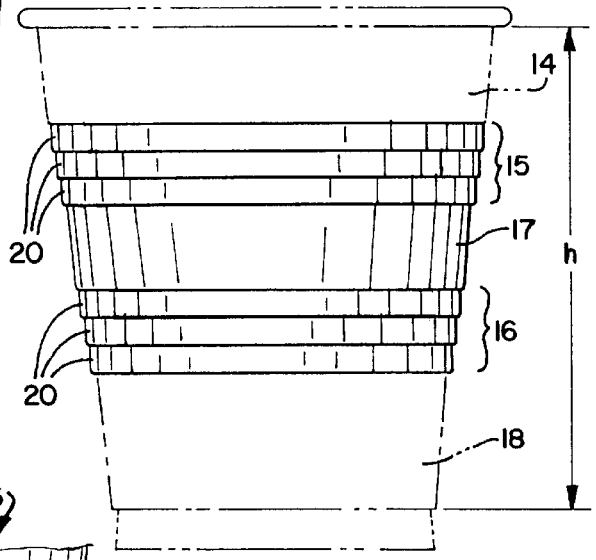
FIG. 6
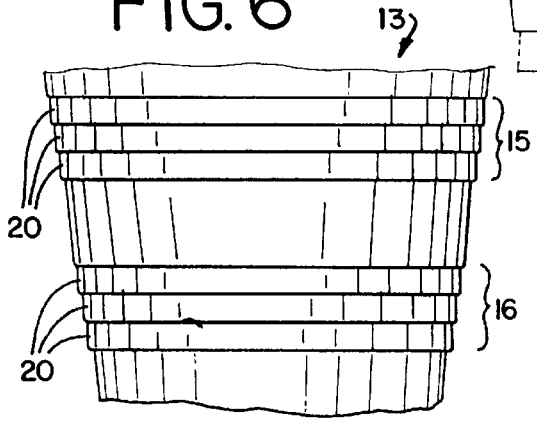

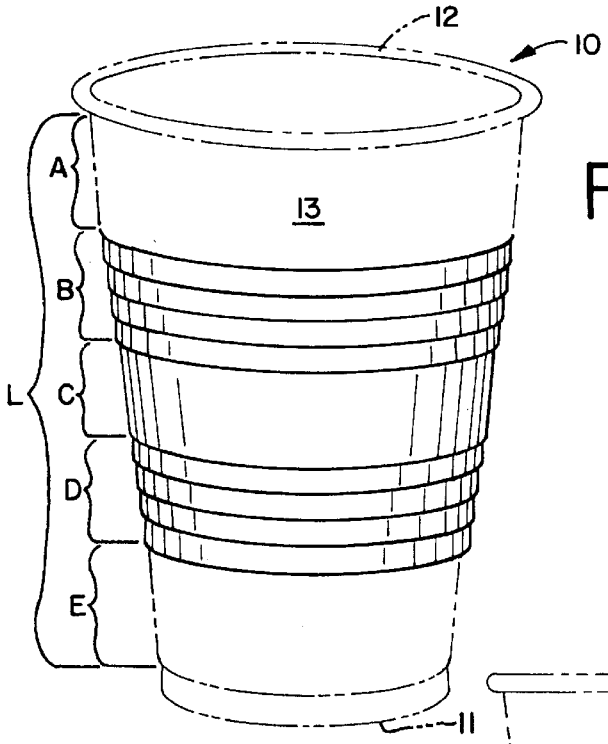
FIG. 7
FIG. 8
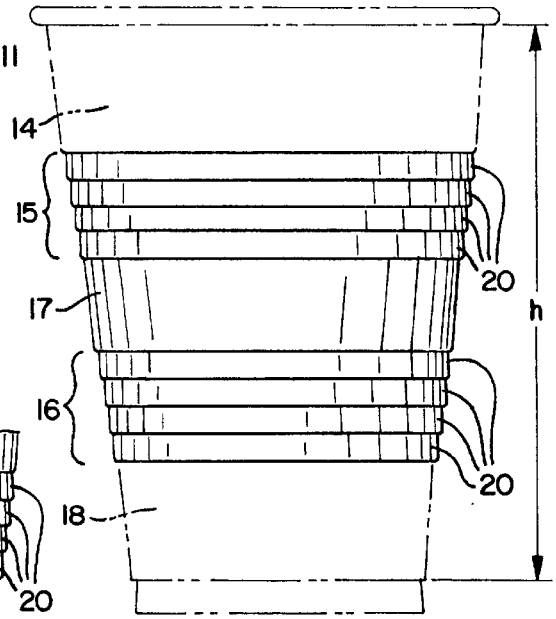
FIG. 9
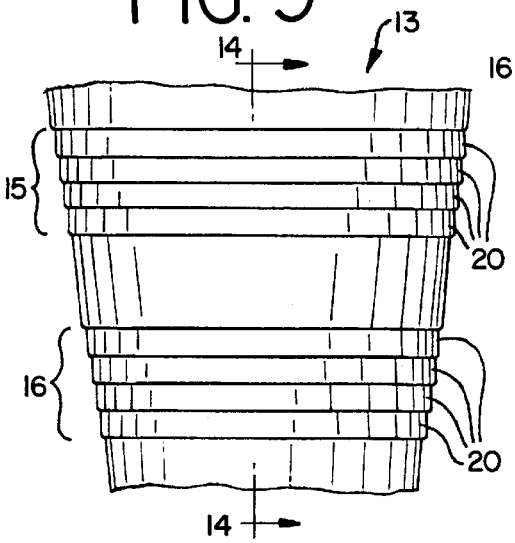

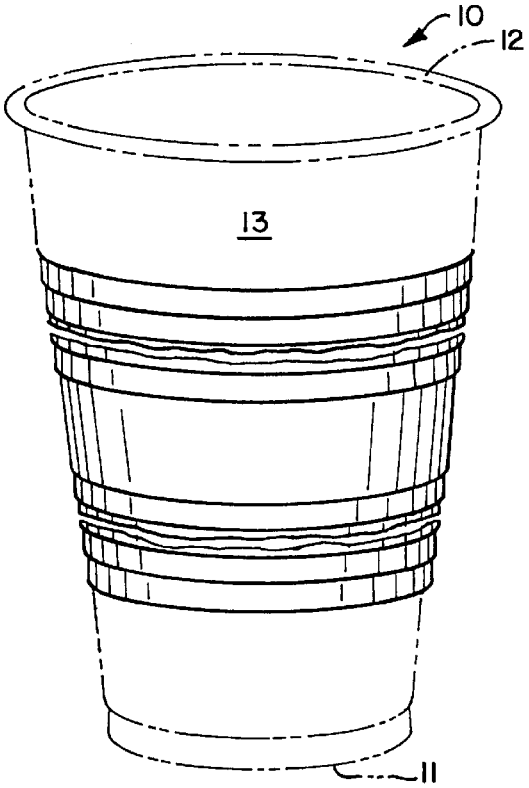
FIG. 10
FIG. 11
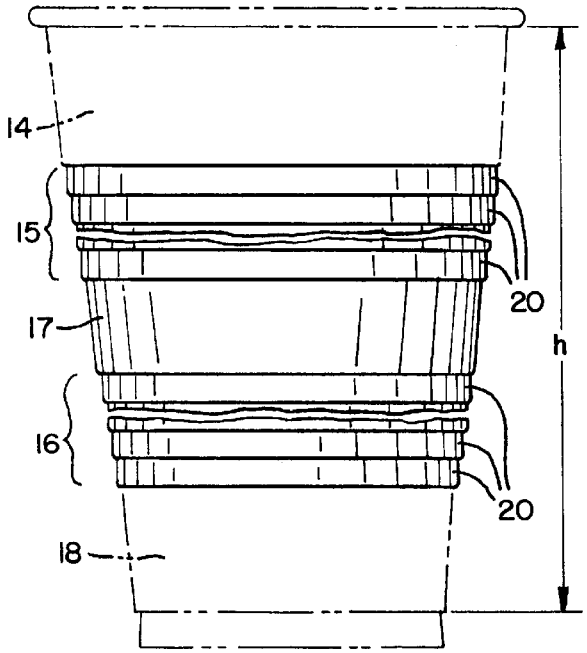

THERMOFORMED CONTAINER HAVING IMPROVED STRENGTH TO WEIGHT RATIO IN SIDEWALL

TECHNICAL FIELD OF THE INVENTION

The present invention relates to the field of thermoforming containers, specifically thermoforming sidewalls of containers, such as cups and the like. More specifically, the present invention relates to improved strength in thermoformed container sidewall designs.

BACKGROUND OF THE INVENTION

The use of disposable containers by consumers at the workplace, in public areas such as parks, beaches, campgrounds, and the like, and even in the home is a growing practice. For many years, thermofoam materials (e.g., Styrofoam®) and insulated paper were the only alternatives to glass or re-usable plasticware containers. However, over the last ten or more years, thermoformed plastic model containers have helped to replace the less environmentally friendly foamed containers in the industry for use with hot and cold contents.

Thermoplastic materials are particularly advantageous because, for manufacturers, they are usually of a single construction, do not require expensive foaming agents, and need no surface lamination—each of which is a feature resulting in less steps in the manufacturing process—and, for consumers, they are generally more durable than paper, still inexpensive and recyclable, and in some cases they can even be washed and reused several times before discarding.

Thermoforming begins with a thin sheet or web of material such as polyethylene, polypropylene, polyester, and polystyrene having a thickness within the range of from about 8 mils to about 100 mils, depending on the size of the container to be made. The sheet or web is heated to a temperature suitable for thermoforming the web—in the range of from about 110° C. to about 200° C. for the above-mentioned materials—and is then fed into a conventional forming machine with the aid of which the thermoforming process takes place under applied vacuum conditions. A mold cavity is used to impart a particular design into the sidewall of the thin-walled container as the plastic material is drawn into the mold using vacuum pressure on one side and a positive pressure on the opposite side of the material. The sidewall design, if any, is often decorative, but may have a secondary function as well (e.g., texturing for grip, rounded shoulders and recesses for stacking, etc.). The processing time for a normal thermoforming operation is typically between 1 and 20 seconds.

One problem with thermoformed plastic containers, however, particularly with respect to drinking cups, is sidewall integrity. Prior art cups are typically made from plastic sheets having a pre-thermoforming thickness of between 30 to 60 mils, but may be thinner after thermoforming. Picking up such a thin-walled cup when filled with a staining colored or hot liquid can sometimes lead to messy or dangerous spills. The problem is with the sidewall design of the container, which is easily deflected inward constricting the volume of the container. Thicker sidewalls may provide a solution, but at the expense of cost or profit margins.

The present invention provides an economical solution. The present invention is directed to providing a suitable sidewall design for thermoformed containers, especially cups, having an improved strength to weight ratio.

SUMMARY OF THE INVENTION

In accordance with the present invention, a new container sidewall, such as for a cup or the like, made of a thermoplastic is disclosed. The container is comprised of a closed bottom wall at one end, an open top at the opposite end, and a sidewall extending between the bottom wall and the open top to define a height. The sidewall has a top portion adjacent the open top of the container, a first set of annular ribs disposed adjacent the top portion, a second set of annular ribs, a middle portion disposed between the first set and second set of annular ribs, and a bottom portion disposed adjacent the closed bottom wall of the container.

In accordance with another aspect of the present invention, the number of ribs in the second set of annular ribs is equal to the number of ribs in the first set of annular ribs. It is an aspect of the invention to provide a container wherein the width of the first set of annular ribs is equal to the width of the second set of annular ribs and each makes up from about 5% to about 40% of the height of the sidewall and wherein the number of ribs in the first and second sets of annular ribs is preferably within the range of from 2 to 10 ribs, and most preferably in the range of from 2 to 5 ribs. Each rib is preferably continuous about the sidewall of the container.

These and other aspects of the present invention set forth in the appended claims may be realized in accordance with the following disclosure with particular reference to the accompanying drawings.

DESCRIPTION OF THE DRAWINGS

To better understand the present invention, it will now be described by way of example, with reference to the accompanying drawings in which:

FIG. 1 is a perspective view of a cup utilizing one embodiment of the present sidewall having two annular ribs in each rib set;

FIGS. 2 and 3 are side views of a cup utilizing the embodiment of the present sidewall having two annular ribs in each rib set as shown in FIG. 1;

FIG. 4 is a perspective view of a cup utilizing one embodiment of the present sidewall having three annular ribs in each rib set;

FIGS. 5 and 6 are side views of a cup utilizing the embodiment of the present sidewall having three annular ribs in each rib set as shown in FIG. 4;

FIG. 7 is a perspective view of a cup utilizing one embodiment of the present sidewall having four annular ribs in each rib set;

FIGS. 8 and 9 are side views of a cup utilizing the embodiment of the present sidewall having four annular ribs in each rib set as shown in FIG. 7;

FIGS. 10 and 11 are a perspective and a side view, respectively, of a cup utilizing one embodiment of the present sidewall having an indeterminate number of annular ribs indicated by the broken lines within each rib set;

DETAILED DESCRIPTION OF PREFERRED EMBODIMENT

Figure 12:
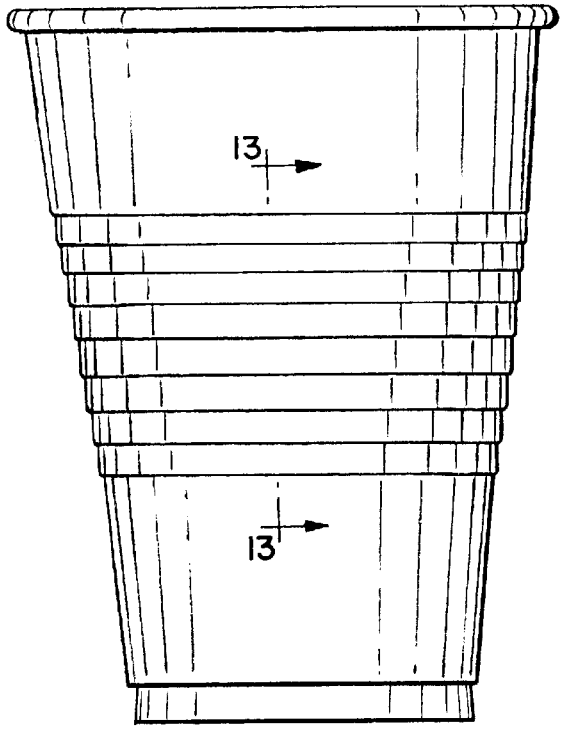
FIG. 12 PRIOR ART
FIG. 12 is a side view of a cup utilizing a prior art sidewall design having a single annular rib set.

While the invention is susceptible of embodiment in many different forms, this disclosure describes, in detail, preferred embodiments of the invention with the understanding that the present disclosure is to be considered as an exemplification of the principles of the invention and is not intended to limit the broad aspects of the invention to the embodiments illustrated.

Referring generally to the appended FIGS. 1–17, the present invention can be more readily understood. The disclosed preferred container is generally referenced by the number "10" in the following disclosure and drawings. Other components are similarly and consistently numbered throughout the specification and drawings. While the present invention is particularly designed for use in thermoformed cups, other similar thermoformed containers may also be capable of utilizing and benefitting from the disclosed design.

As illustrated in the numerous FIGURES, the container 10 is generally made of a thermoplastic material and includes a closed bottom wall 11 at one end, an open top 12 at the opposite end, and a sidewall 13 extending between the bottom wall 11 and the open top 12 to define a height (h). The sidewall 13 comprises a top portion 14, a first set of annular ribs 15, a second set of annular ribs 16 separated or spaced apart from the first set of ribs 15, a middle portion 17 disposed between the first set and second set of annular ribs, 15 and 16, respectively, and a bottom portion 18.

The double set of annular ribs, 15 and 16, provide increased sidewall integrity to the container 10 over prior art designs. The particular cup design of the preferred embodiment may come is several sizes, typically delineated by the volume of the container, such as 7 ounce, 10 ounce, 12 ounce, 16 ounce, 20 ounce, and 32 ounce sizes. The number of ribs 20 in each set, 15 and 16, and the width of the rib sets, 15 and 16, will necessarily vary with the size of the container 10. Preferably the number of ribs 20 is within the range of from 2 to 10 per set, and most preferably in the range of from 2 to 5 ribs per set. It is also preferred to have the number of ribs 20 in the first set of ribs 15 equal to the number of ribs in the second set of ribs 16. For example, a 7 ounce and a 10 ounce cup might comprise two ribs 20 in each set, 15 and 16, as represented in FIGS. 1–3; the 12 ounce and 16 ounce cup might comprise three ribs in each set, 15 and 16, as represented in FIGS. 4–6; the 20 ounce cup might have four ribs 20 in each set, 15 and 16, as represented in FIGS. 7–9; and, the larger cups (e.g., 32 ounce cups and bigger) might have increasing numbers of ribs 20 in each set, 15 and 16, as indicated by the indeterminate quantity of ribs illustrated in FIGS. 10 and 11.

Notwithstanding these stated preferences, it is certainly possible to employ a different number of ribs 20 in the first rib set 15 than in the second rib set 16. It should be understood that such a modification would certainly fall within the intended scope of the present invention.

Figure 13:
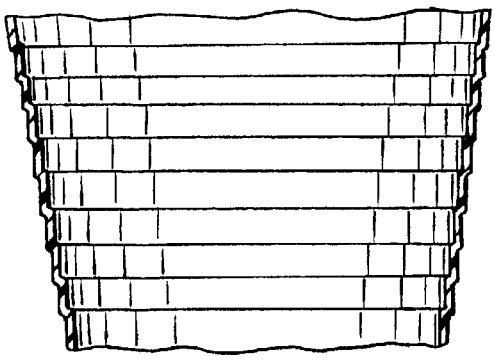
FIG. 13 PRIOR ART
FIG. 13 is a cross-section of the annular rib section of the prior art sidewall shown in FIG. 12 taken through line 13—13.

With respect to the annular ribs 20, there are design similarities between the ribs 20 within each set, 15 and 16. The method for incorporating a rib 20 into the design of a container sidewall is well-known and understood by those skilled in the art. For example, it is well-known that the thermoformed ribs 20 will have a radiused rather than sharp-edged surface, as shown more clearly in FIGS. 15 and 17. However, as shown in FIGS. 12 and 13, those skilled in the art have always chosen to provide a single set of annular ribs at the middle of the sidewall.

Figure 14:
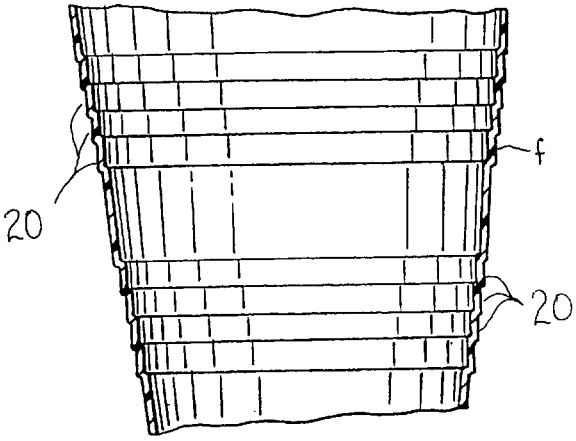
FIG. 14 is a cross-section of the annular rib sets of the present sidewall shown in FIG. 9 taken through line 14—14.
Figure 17:
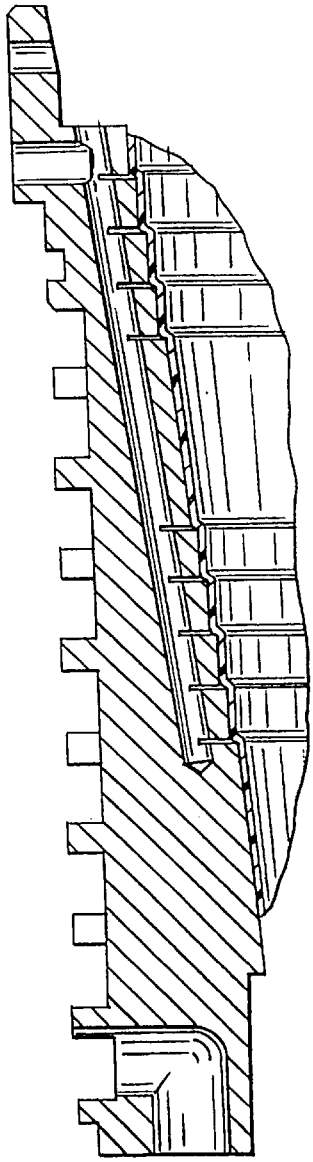
FIG. 17 is a side view of a partial cross-section of a mold cavity illustrating the forming of a present sidewall.
Figure 15:
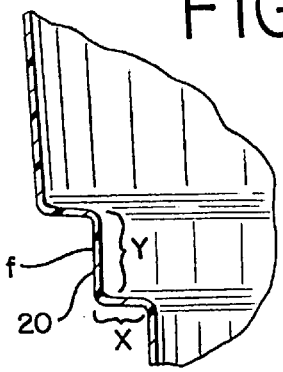
FIG. 15 is an enlarged cut-away section of the sidewall shown in FIG. 14 to show the cross-section detail of one annular rib.
Figure 16:
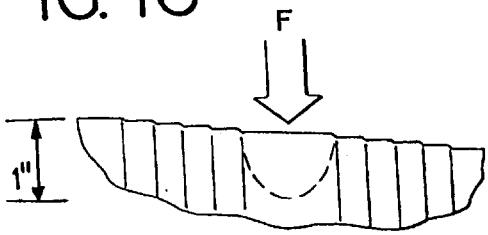
FIG. 16 is a side view illustrating a sidewall deflection test being performed on an embodiment of the present sidewall.

Referring to the cross-section and detail of FIGS. 14 and 15, each of the ribs 20 is identified by a rise (x) and a run (y). The rise (x) of each rib 20 within each set is substantially equal, and the run (y) of each rib 20 within each set is also substantially equal. The surface of the run (y) or face (f) of each rib 20 is, however, preferably substantially perpendicular to the plane of the closed bottom wall 11. The result for each annular rib set is a slightly increased circumference in the upward direction (i.e., from the bottom wall 11 toward the open top 12) to continue the frustoconical shape of the sidewall 13.

With the cup embodiment of FIGS. 1 through 11 the top, middle, and bottom portions, 14,17, and 18, respectively, are preferably slanted from vertical (see θ in FIG. 2) such that the circumference of the cup 10 increases upwardly.

In possible alternative embodiments (not shown) the sidewalls may be designed with ribs which are intermittent about the container circumference. That is, some or all of the ribs 20 may be continuous or periodic, having discontinuities of various frequencies and lengths too numerous to provide an exhaustive discussion herein.

In the preferred embodiment of FIGS. 1–9, the width of the annular rib sets, 15 and 16, are widely variable. The width of the first annular rib set 15 is represented in FIG. 7 as "B", while the width of the second annular rib set 16 is represented as "D". Widths "A", "C", and "E" represent the top, middle, and bottom portions, respectively, of the cup sidewall 13. While the widths of the five sidewall portions (14, 15, 16, 17, and 18) will vary based on the length of the sidewall 13, the ratio of each portion to the overall length, "L", of the sidewall 13 is preferably more consistent.

For example, the width (A) of top portion 14 may comprise approximately 20% to about 32% of the length (L) of the sidewall 13, and most preferably about 22% to about 24%. The widths of portions 15, 16, and 18 (B, D, and E, respectively) are approximately equal, and may each comprise from about 5% to about 30%–40% for portions 15 and 16—of the length (L) of the sidewall 13, and most preferably about 20% to about 24%. The width (C) of middle portion 17 may comprise only about 10% to about 17% of the length (L) of the sidewall 13, and most preferably about 14% to about 16%. In other embodiments the preferred percentages may be different than those expressed above.

In order to demonstrate superior strength-to-weight in the present design, sidewall deflection tests were performed using single-band cups (the "old design"), shown in FIGS. 12 and 13, and cups using the sidewall design of the present invention (the "new design"). Both 16 ounce cups and 18 ounce cups were tested, with the results shown in the columns of TABLES 1 and 2, respectively, below. The test data was compiled using the sidewall deflection test outlined generally below and illustrated in FIG. 16.

Sidewall Deflection Test

A. Preferred Materials:

1. Several Old design Cups, 16 oz. and 18 oz. sizes
2. Several New design Cups, 16 oz. and 18 oz. sizes
3. Chatillon DFGS Digital Force Gauge
4. Chatillon TCD-200 Tension/Compression Tester (Test Stand)
5. Cup Rigidity Fixture
6. Chatillon AutoTest™ Software (optional)

B. Preferred Procedure:

1. Set up test equipment:
   a. attach the cup rigidity fixture to the test stand, making sure it is level;
   b. align cup mounting fixture to permit test deflection at two-thirds (⅔) height of cup (the most commonly grasped area of cup)(this step will need to be repeated when changing the size of cups being tested, e.g., 16 oz. to 18 oz.);
   c. zero gauges, set deflection limit at one inch, and set deflection equipment travel speeds;
2. Begin testing sidewall deflection:
   a. place first test sample into cup mounting fixture;
   b. slowly lower probe of force gauge onto test sample;
   c. when sidewall of test sample deflects one inch (deflection limit) read and record maximum force value on gauge;
   d. repeat steps B(2)(a)–(c) for each cup in each design;
   e. analyze test data.

TABLE 1 below sets forth the data from numerous deflection tests on the two 16 ounce designs. The "Mean Cup Weight" reflects the average weight, in ounces, of all cups in the particular design. The "Mean Cup Force" reflects the average force, in ounces, at which the cup sidewall deflected one inch. The "Ratio" is merely the force divided by the weight, and the "Change in Ratio" reflects the improvement of the new design in the strength-to-weight ratio. The preferred 16 ounce cup is made from a sheet thickness preferably within the range of from about 30 to about 50 mils. Most preferably, the sheet thickness used for the 16 ounce cup is within the range of from about 40 to about 45 mils.

TABLE 1

Strength-to-Weight data on 16 oz. Cup Sidewalls

| Design | Mean Cup Weight (oz.) | Mean Cup Force (oz.) | Ratio | Change in Ratio |
|---|---|---|---|---|
| Old | 0.35960 | 10.210 | 28.393 | |
| New | 0.33433 | 9.994 | 29.893 | +1.5 |

The same data was collected on 18 ounce cups using seven different runs of the new design having various sheet thickness within the most preferred thickness range of from about 35 to about 40 mils. The "old" design used a heavier thickness, within the range of from 44 to about 50 mils. The results are summarized in TABLE 2 below.

TABLE 2

Strength-to-Weight data on 18 oz. Cup Sidewalls

| Design | Sheet Thickness (mils) | Mean Cup Weight (oz.) | Mean Cup Force (oz.) | Ratio | Change in Ratio |
|---|---|---|---|---|---|
| Old | 44 to 50 | 0.42917 | 14.742 | 34.350 | |
| New: | | | | | |
| A | 35 to 45 | 0.37395 | 13.987 | 37.403 | +3.053 |
| B | 35 to 45 | 0.37855 | 13.958 | 36.872 | +2.522 |
| C | 35 to 45 | 0.36736 | 14.497 | 39.463 | +5.113 |
| D | 35 to 45 | 0.35486 | 14.342 | 40.416 | +6.066 |
| E | 35 to 45 | 0.35283 | 13.273 | 37.619 | +3.269 |
| F | 35 to 45 | 0.39654 | 16.133 | 40.684 | +6.334 |
| G | 35 to 45 | 0.41633 | 16.604 | 39.882 | +5.532 |

Clearly, with a positive change in the strength-to-weight ratio over the "old design" of 5.3% in the 16 ounce cups (1.5/28.393×100%) and a positive change ranging from 7.3% (2.522/34.350×100%) to 18.4% (6.334/34.350×100%) in the 18 ounce cups, the present double band sidewall design is a commanding improvement over the single band sidewall design tested. Containers utilizing the disclosed design, including alternative embodiments, can provide a large increase in strength with the same weight container, a lesser increase in strength with a lighter weight container, or even the same strength with a much lighter weight container.

While specific embodiments have been illustrated and described, numerous modifications are possible without departing from the spirit of the invention, and the scope of protection is only limited by the scope of the accompanying claims.

We claim:

1. A container sidewall made of a thermoplastic material, the container comprising a closed bottom wall at one end, an open top area defined at an opposite end, and a sidewall extending between the bottom wall and the open top to define a height, the sidewall comprising:

a top portion having a smooth exterior surface adjacent the open top area of the container;

a first set of annular ribs having a width and disposed adjacent the top portion;

a second set of annular ribs having a width and separate from the first set of annular ribs;

a middle portion having a width, a smooth exterior surface and disposed between the first set and second set of annular ribs;

a bottom portion having a smooth exterior surface disposed adjacent the closed bottom wall of the container; and an improved sidewall strength to container weight ratio of at least 5% over a substantially similar container sidewall having only a single set of annular ribs, the strength being determined by the force required to deflect the sidewall approximately one inch.

2. The container sidewall of claim 1 wherein the number of ribs in the second set of annular ribs is equal to the number of ribs in the first set of annular ribs.

3. The container sidewall of claim 2 wherein the number of ribs in the first set of annular ribs is within the range of from 2 to 10 ribs.

4. The container sidewall of claim 3 wherein the number of ribs in the first set of annular ribs is within the range of from 2 to 5 ribs.

5. The container sidewall of claim 2 wherein the number of ribs in the second set of annular ribs is within the range of from 2 to 10 ribs.

6. The container sidewall of claim 5 wherein the number of ribs in the second set of annular ribs is within the range of from 2 to 5 ribs.

7. The container sidewall of claim 1 wherein the width of the first set of annular ribs is equal to the width of the second set of annular ribs.

8. The container sidewall of claim 1 wherein each of the ribs of the first set of annular ribs has a rise and a run, and the rise of each rib of the first set is substantially equal and the run of each rib of the first set is substantially equal.

9. The container sidewall of claim 1 wherein each of the ribs of the second set of annular ribs has a rise and a run, and the rise of each rib of the second set is substantially equal and the run of each rib of the second set is substantially equal.

10. The container sidewall of claim 1 wherein each of the ribs of the first and second sets of annular ribs has a rise and a run, and the rise of each rib in both sets is substantially equal and the run of each rib in both sets is substantially equal.

11. The container sidewall of claim 1 wherein the width of the middle portion of the sidewall is less than the width of the first set of annular ribs.

12. The container sidewall of claim 11 wherein a ratio of the width of the middle portion of the sidewall to the width of the first set of annular ribs is within the range of from about 1:3 to about 3:1.

13. The container sidewall of claim 1 wherein the width of the middle portion of the sidewall is less than the width of the second set of annular ribs.

14. The container sidewall of claim 12 wherein the ratio is within the range of from about 1:2 to about 2:1.

15. The container sidewall of claim 14 wherein the ratio is about 4:5.

16. The container sidewall of claim 13 wherein a ratio of the width of the middle portion of the sidewall to the width of the second set of annular ribs is within the range of from about 1:3 to about 3:1.

17. The container sidewall of claim 16 wherein the ratio is within the range of from about 1:2 to about 2:1.

18. The container sidewall of claim 17 wherein the ratio is about 4:5.

19. The container sidewall of claim 1 wherein a ratio of the width of the middle portion of the sidewall to the width of either the first set or second set of annular ribs is within the range of from about 1:3 to about 3:1.

20. The container sidewall of claim 19 wherein the ratio is within the range of from about 1:2 to about 2:1.

21. The container sidewall of claim 20 wherein the ratio is about 4:5.

22. The container sidewall of claim 1 wherein each rib of each set of annular ribs is continuous about the sidewall of the container.

23. The container sidewall of claim 1 wherein at least some of the ribs of each set of annular ribs are continuous about the sidewall of the container.

24. The container sidewall of claim 1 wherein the width of the first set of annular ribs is within the range of from about 5% to about 40% of the height of the sidewall.

25. The container sidewall of claim 1 wherein the width of the second set of annular ribs is within the range of from about 5% to about 40% of the height of the sidewall.

26. The container sidewall of claim 1 further comprising an improved strength to weight ratio of at least 7% over a substantially similar container sidewall having only a single set of annular ribs.

27. A container sidewall made of a thermoplastic material, the container comprising a closed bottom wall at one end, an open top area defined at an opposite end, and a sidewall extending between the bottom wall and the open top to define a height, the sidewall comprising:

a top portion having a width, a smooth exterior surface and adjacent the open top area of the container;

a first set of annular ribs having a width and disposed adjacent the top portion, wherein the width of the first set of annular ribs is within the range of from about 5% to about 40% of the height of the sidewall;

a second set of annular ribs having a width and separate from the first set of annular ribs, wherein the width of the second set of annular ribs is within the range of from about 5% to about 40% of the height of the sidewall, and the number of ribs in the second set of annular ribs is identical to the number of ribs in the first set of annular ribs;

a middle portion having a width, a smooth exterior surface and disposed between the first set and second set of annular ribs, wherein the width of the middle portion of the sidewall is less than the width of the first set of annular ribs and the width of the second set of annular ribs;

a bottom portion having a width, a smooth exterior surface and disposed adjacent the closed bottom wall of the container; and an improved sidewall strength to container weight ratio of at least 5% over a substantially similar container sidewall having only a single set of annular ribs, the strength being determined by the force required to deflect the sidewall approximately one inch.

28. The container sidewall of claim 27 wherein a ratio of the width of the middle portion of the sidewall to the width of either the first set or second set of annular ribs is 5:4.

29. The container sidewall of claim 27 wherein each rib of each set of annular ribs is continuous about the sidewall of the container.

30. The container sidewall of claim 27 wherein at least some of the ribs of each set of annular ribs are continuous about the sidewall of the container.

31. The container sidewall of claim 27 wherein each of the ribs of the first and second sets of annular ribs has a rise and a run, and the rise of each rib in both sets is substantially equal and the run of each rib in both sets is substantially equal.

32. The container sidewall of claim 27 wherein the number of ribs in the first and second sets of annular ribs is within the range of from 2 to 10 ribs.

33. The container sidewall of claim 27 further comprising an improved strength to weight ratio of at least 7% over a substantially similar container sidewall having only a single set of annular ribs.

34. A cup comprising:

a closed bottom wall;

an open top area defined opposite the closed bottom wall;

a sidewall extending between the bottom wall and the open top area to define a height and forming a truncated, substantially-conical shape, the sidewall comprising:

a top sidewall portion having a width, a smooth exterior surface and disposed adjacent the open top area of the container;

a first set of annular ribs having a width and disposed on the sidewall adjacent the top portion;

a second set of annular ribs having a width and separate from the first set of annular ribs on the sidewall;

a middle sidewall portion having a width, a smooth exterior surface and disposed between the first set and second set of annular ribs;

a bottom sidewall portion having a width, a smooth exterior surface and disposed adjacent the closed bottom wall of the container; and an improved sidewall strength to cup weight ratio of at least 5% over a substantially similar cup sidewall having only a single set of annular ribs, the strength being determined by the force required to deflect the sidewall approximately one inch.

35. The cup of claim 34 wherein the number of ribs in the second set of annular ribs is equal to the number of ribs in the first set of annular ribs.

36. The cup of claim 35 wherein the number of ribs in the first set of annular ribs is within the range of from 2 to 10 ribs.

37. The cup of claim 36 wherein the number of ribs in the first set of annular ribs is within the range of from 2 to 5 ribs.

38. The cup of claim 35 wherein the number of ribs in the second set of annular ribs is within the range of from 2 to 10 ribs.

39. The cup of claim 38 wherein the number of ribs in the second set of annular ribs is within the range of from 2 to 5 ribs.

40. The cup of claim 34 wherein the width of the first set of annular ribs is equal to the width of the second set of annular ribs.

41. The cup of claim 34 wherein each of the ribs of the first set of annular ribs has a rise and a run, and the rise of each rib of the first set is substantially equal and the run of each rib of the first set is substantially equal.

42. The cup of claim 34 wherein each of the ribs of the second set of annular ribs has a rise and a run, and the rise of each rib of the second set is substantially equal and the run of each rib of the second set is substantially equal.

43. The cup of claim 34 wherein each of the ribs of the first and second sets of annular ribs has a rise and a run, and the rise of each rib in both sets is substantially equal and the run of each rib in both sets is substantially equal.

44. The cup of claim 34 wherein the width of the middle sidewall portion of the cup is less than the width of the first set of annular ribs.

45. The cup of claim 44 wherein a ratio of the width of the middle sidewall portion of the cup to the width of the first set of annular ribs is within the range of from about 1:3 to about 3:1.

46. The cup of claim 45 wherein the ratio is within the range of from about 1:2 to about 2:1.

47. The cup of claim 46 wherein the ratio is about 4:5.

48. The cup of claim 34 wherein the width of the middle sidewall portion of the cup is less than the width of the second set of annular ribs.

49. The cup of claim 48 wherein a ratio of the width of the middle sidewall portion of the cup to the width of the second set of annular ribs is within the range of from about 1:3 to about 3:1.

50. The cup of claim 49 wherein the ratio is within the range of from about 1:2 to about 2:1.

51. The cup of claim 50 wherein the ratio is about 4:5.

52. The cup of claim 34 wherein a ratio of the width of the middle sidewall portion of the cup to the width of either the first set or second set of annular ribs is within the range of from about 1:3 to about 3:1.

53. The cup of claim 52 wherein the ratio is within the range of from about 1:2 to about 2:1.

54. The cup of claim 53 wherein the ratio is about 4:5.

55. The cup of claim 34 wherein each rib of each set of annular ribs is continuous about the sidewall of the container.

56. The cup of claim 34 wherein at least some of the ribs of each set of annular ribs are continuous about the sidewall of the container.

57. The cup of claim 34 wherein the width of the first set of annular ribs is within the range of from about 5% to about 40% of the height of the sidewall.

58. The cup of claim 34 wherein the width of the second set of annular ribs is within the range of from about 5% to about 40% of the height of the sidewall.

59. The cup of claim 34 further comprising an improved strength to weight ratio of at least 7% over a substantially similar sidewall having only a single set of annular ribs.

* * * * *